United States Patent [19]

Kuhn

[11] Patent Number: 4,720,991

[45] Date of Patent: Jan. 26, 1988

[54] SINGLE ANCHOR SECONDARY SAFETY TIE DOWN FOR A PULLING APPARATUS

[75] Inventor: Charles J. Kuhn, Tujunga, Calif.

[73] Assignee: Kuhn Manufacturing Co., Inc., Sun Valley, Calif.

[21] Appl. No.: 926,393

[22] Filed: Nov. 3, 1986

[51] Int. Cl.[4] ..... B21D 1/12

[52] U.S. Cl. ..... 72/457; 72/705; 52/704

[58] Field of Search ..... 72/457, 705; 52/704; 410/101, 102, 109, 112

[56] References Cited

U.S. PATENT DOCUMENTS

| | | | |
|---|---|---|---|
| 3,623,353 | 11/1971 | Dinerman | 72/705 |
| 4,070,834 | 1/1978 | Jameson | 72/705 |
| 4,574,613 | 3/1986 | Doughty | 72/705 |
| 4,590,732 | 5/1986 | Hallman | 72/705 |

*Primary Examiner*—Lowell A. Larson

*Attorney, Agent, or Firm*—Christie, Parker & Hale

[57] ABSTRACT

A safety tie down assembly is adapted for use with pulling apparatus of the type used in the repair of collision damage to motor vehicles. The pulling apparatus includes a post carrying a power cylinder attached to a pulling chain which passes over a guide pulley on the post and then to the vehicle so that force applied to the piston in the cylinder applies a pulling force to the vehicle through the pulling chain. The pulling force is counteracted by a primary anchor chain coupled to the post and extending to a floor anchor. The safety tie down assembly comprises a rigid anchor guide and support removably placed in the floor anchor and contacted by the primary anchor chain so that the restraining force in the primary anchor chain is evenly distributed at the edge of the floor anchor to prevent damage to the floor. A safety anchor line is connected to a separate location on the post assembly and is then connected to a ring-like cable carried on the rigid anchor guide and support. The safety anchor line provides a safety device that prevents the post from jumping forward toward the vehicle by restraining its movement should the primary anchor line break or otherwise let loose.

17 Claims, 5 Drawing Figures

SINGLE ANCHOR SECONDARY SAFETY TIE DOWN FOR A PULLING APPARATUS

FIELD OF THE INVENTION

This invention relates generally to pulling apparatus used in body shops for the repair of collision damage to motor vehicles, and more particularly, to a safety tie down system for use with such pulling apparatus.

BACKGROUND OF THE INVENTION

Various types of pulling apparatus have long been used in vehicle body and frame repair shops. Generally, both pulling apparatus falls into two categories: the more permanently installed frame rack-type straightening equipment and the lighter weight and portable post-type pulling devices which are moved around the body shop and anchored at various locations for making pulls in different directions. The more permanently installed frame rack or frame rail devices are much more expensive and are less versatile than the portable post-type straightening apparatus. It is the portable post-type pulling devices to which the present invention is directed.

Generally, post-type pulling apparatus comprises one or more vertically extending support members formed as a rigid post and having a guide such as a pulley attached to various elevations along the post. It is common to provide a plurality of vertically spaced apart holes in the post, and a shaft on which the pulley rotates can be inserted through the holes to vary the elevation of the pulley on the post. A pulling chain is led over the pulley and one end of the pulling chain is attached to a portion of a vehicle to which a pulling force is applied. The post also carries a tensioning device, generally a hydraulically-actuated piston arranged so that the other end of the pulling chain is connected to the hydraulic ram for exerting a pulling force on the portion of the vehicle to which the other end of the pulling chain is attached.

In use, the pulling apparatus rests on the floor of the body shop in a free-standing manner in the sense that the base of the post is not permanently or otherwise rigidly affixed to the floor, but simply rests on the floor. The post is anchored during a pull by an anchor chain extending from the post to at least one anchor pot embedded in the floor on a side of the post opposite from the side on which the pulling chain is attached to the vehicle. The anchor chain counteracts the pulling force exerted on the vehicle by the pulling chain.

Thus, the pulling apparatus is securely held in place by the counter-balancing forces as long as the anchor assembly remains firmly intact. However, if the anchor chain breaks or becomes detached from the floor anchor or the floor anchor otherwise lets loose during a pulling operation, the sudden release of the anchoring restraint may cause the pulling apparatus to move toward the vehicle in a violent manner. Such pulling apparatus is often subjected to rugged use or even occasional misuse, and routine inspection practices may not be adhered to by those using the equipment. The anchoring chain may become worn, fatigued or otherwise weakened, and inasmuch as there is often no convenient means for determining whether a link in the chain may be weakened, the chain may break under the stress of a pulling operation, and thereby allow the pulling apparatus to jump toward the vehicle with violence.

My U.S. Pat. No. 4,175,420 describes an approach to solving the problem of anchor chain failure, by providing attachment members on the post in combination with safety tie down anchoring lines attached at their free ends to floor anchors adjacent the pulling apparatus. The safety tie downs restrain or otherwise limit movement of the pulling post should a failure occur in the anchor assembly. In the safety tie down system disclosed in my patent, the safety tie down lines are preferably auxiliary cables or chains which extend from the sides of the post in a direction generally angularly outwardly away from the direction in which the pulling chain extends. The anchor lines thus extend generally toward the rear of the post, in the direction generally toward which the primary anchoring chain extends. Thus, if the anchor chain fails or the anchor pot becomes loose or pulls out of the floor, the safety tie down lines prevent the post from jumping forward.

Although the safety tie down apparatus disclosed in my '420 patent has proved to be an enormous success commercially, the present invention provides further improvements to the safety of post-type pulling apparatus. For instance, the safety tie down apparatus disclosed in my '420 patent requires that the safety tie down lines be connected to auxiliary anchor pots located to the rear and spaced laterally outwardly from both sides of the post, so that the safety tie down lines extend to the rear of the post in an outwardly diverging pattern. This requires that the floor of the repair shop have an array of anchor pots available so that the safety tie down lines can be fastened to two additional anchor pots, over and above the anchor pot or pots to which the primary anchor chain is attached. This requires repairmen to take the additional time to connect the safety tie down lines to both anchor pots each time a pull is to be made. Because of the additional setup time required to properly restrain the post, many repairmen disregard safety and use the post without attaching the safety tie down lines. Moreover, if the pulling post is located in any one of the four corner regions of the anchor pot array on the floor, then there may not be anchor pots available at the necessary locations on the floor for attachment of both safety tie down lines, even if the repairman wants to attach the safety tie down lines.

Therefore, there is a need to provide a safety tie down system for the free-standing type of pulling post which simplifies the steps necessary to safely hook up the post with each repositioning of the post. The safety tie down arrangement also should be capable of use in any region of a floor array of anchor pots, including any of the corner regions. In this way, the repairman will be able to readily use the safety tie down arrangement for applying pulls in all directions; and as a result, the repairman will be more encouraged to use the safety tie down system when each and every pulling force is applied.

SUMMARY OF THE INVENTION

Briefly, one embodiment of the invention comprises a safety tie down assembly for a pulling apparatus which includes a post assembly, guide means and power means on the post assembly, and a flexible pulling means having one end connected to the power means and extending into engagement with the guide means with the other end adapted for connection to a work piece. Primary anchor means restrain the post during a pull from the pulling means. The primary anchor means comprises at least one flexible anchor line having one end secured to the post assembly with the opposite end adapted for connection to an anchor pot on the floor on a side of the post opposite from the work piece to which the pull is applied. A safety tie down assembly includes a secondary flexible anchor line having one end connected to the post assembly and extending toward the same anchor pot to which the primary anchor line is attached. A combined chain rest and safety line anchor is supported in the anchor pot. The primary anchor line engages the chain rest when held in tension between the post assembly and the anchor pot during a pull. One end of the secondary anchor line is also connected to the post assembly, and the opposite end of the secondary anchor line is connected to the chain rest and safety line anchor. The secondary anchor line restrains movement of the pulling apparatus along the line in which a pulling force is directed when force is applied to the pulling chain and restrained by tension in the primary anchor line. Should the primary anchor line fail, the secondary anchor line then restrains movement of the post toward the work piece.

In a preferred embodiment, the combined chain rest and safety line anchor is removably placed within the anchor pot so that it releasably engages a fixed anchor point in the anchor pot. Tension in the primary anchor line during use applies pressure to the fixed anchor point in the anchor pot to hold the chain rest and safety line anchor in the anchor pot while the primary anchor line is under tension. Force against the chain rest and safety line anchor also is applied to the floor area adjacent the anchor pot when the primary anchor line is under tension. This fixed anchoring point provided by the chain rest and safety line anchor provides a fixed anchoring point to which the secondary anchor line is connected for providing the safety tie down for the post.

Thus, the repairman can easily connect the primary anchor line to the anchor pot and place the chain rest and safety line anchor inside the anchor pot to provide the bearing surface for the primary anchor line when line tensioned. The secondary anchor is then easily connected to the safety line anchor in the same anchor pot. The hookup can be done quickly and needs only one anchor pot to provide the floor anchor for the primary anchor line and the secondary safety line for the same pull. In addition, since the safety line anchor is removable from the anchor pot, it can easily be set up, removed after the pull is made, and set up at another anchor pot for the next pull. This ease of connection for the primary and secondary anchor lines at the same floor anchor greatly reduces the time required for the repairman to safely hook up the post before each pull is made. Moreover, because the primary and secondary anchor lines are attached to the same single anchor pot, it is possible to make a safe pull at any point within the array of floor pots within the repair shop.

These and other aspects of the invention will be more fully understood by referring to the following detailed description and the accompanying drawings.

DRAWINGS

DETAILED DESCRIPTION

Figure 1:
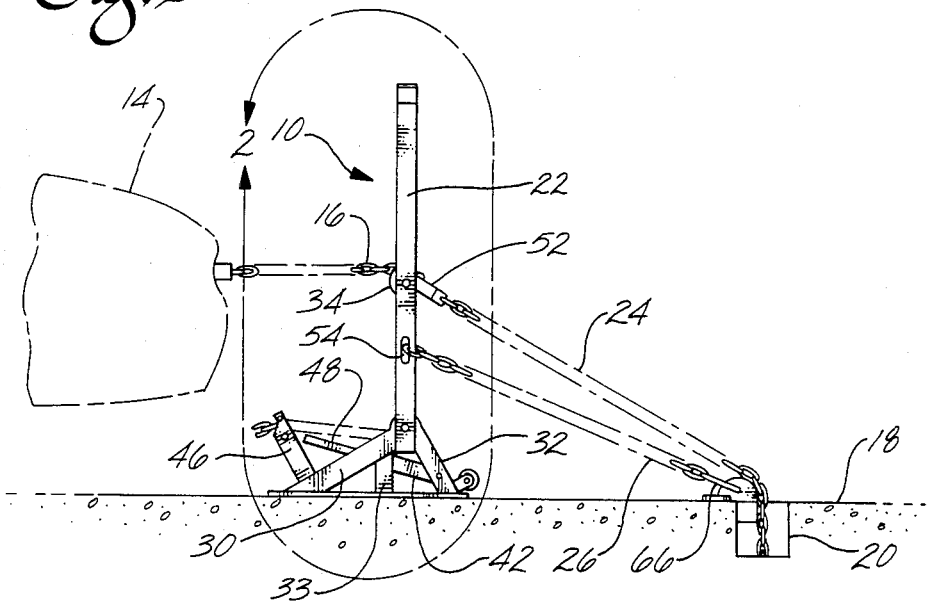
FIG. 1 is a side elevation view illustrating use of the safety tie down apparatus according to principles of this invention.
Figure 2:
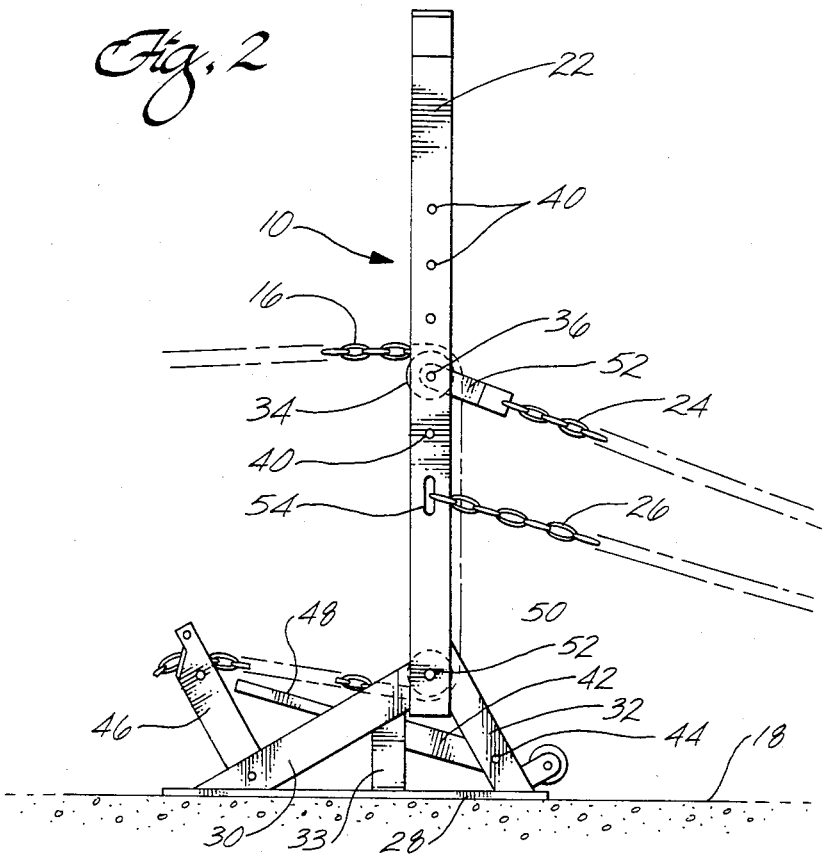
FIG. 2 is a fragmentary side elevation of the apparatus shown within the circle 2 of FIG. 1.

Referring to FIGS. 1 and 2, a pulling apparatus 10 has a safety tie down assembly 12 in accordance with the present invention illustrated in use applying a pulling force to a work piece such as motor vehicle 14 through a flexible high strength pulling chain 16. The pulling chain may be any type of tension line or cable for applying the necessary force to the work piece. Pulling forces over ten tons are common in the industry. The pulling apparatus 10 is supported upon a generally horizontal floor 18, and the pulling apparatus is anchored to an anchor pot 20 which can be one of various types of anchor pots commonly used in the auto body and frame repair industry. Briefly, the pulling apparatus 10 includes an upright post 22 for supporting the pulling chain 16. The force applied to the pulling chain is counteracted by a primary anchor chain 24 extending from the post to the anchor pot 20. The anchor chain 24 is connected to the anchor pot which, in, turn is embedded in or otherwise secured to the floor so as to counteract the pulling force exerted on the vehicle by the pulling chain. The anchor chain 24 may be any type of tension line or cable capable of resisting the force applied by the pulling chain. FIG. 1 also shows a secondary anchor chain 26, also referred to herein as a safety tie down line, which is also connected between the upright post 22 and the anchor pot 20. The safety tie down line extends in the direction opposite from the pulling chain 16 and, as described in more detail below, provides a secondary means for counteracting the pulling force exerted on the vehicle by the pulling chain 16. In the event the primary anchor chain 24 fails or is otherwise dislodged from its mooring in the anchor pot 20, the safety tie down line provides the restraint that prevents the post from jumping forward toward the vehicle.

The anchor pot shown in FIGS. 1 and 2 is an example of various types of floor anchors used in the auto body and frame repair industry, wherein such anchor pots include an outer cylinder embedded within a drilled recess formed in a concrete floor. The hollow interior of the cylinder has a fixed attachment point such as an anchored chain link inside the cylinder housing. The end of the primary anchor chain is attached to the fixed anchor point inside the floor anchor. The primary anchor chain then passes over a curved guide at the edge of the cylinder so that the guide not only functions as a guide for the anchor chain but also as a support for the load-carrying end of the anchor chain. The guide (described below) thus prevents damage to the floor adjacent the anchor pot when pulling forces are applied and restrained by tension in the anchor chain. The floor anchor can be the type shown in my U.S. Pat. Nos. 3,494,587 or 4,151,974, which are incorporated herein by this reference.

The pulling apparatus 10 illustrated in FIGS. 1 and 2 may be any of the types of free-standing and portable pulling devices common in the body and frame repair industry. Generally, in such pulling apparatus, an upright post supports a pulley or the like for adjusting the elevation of a pulling chain attached to a force-applying arm carried on a base of the post. The force of the pulling chain applied to the vehicle is restrained by an anchor chain extending in an opposite direction from the pull to a floor anchor. Such a pulling apparatus may be the type disclosed in my U.S. Pat. Nos. 3,589,680, 4,175,420 or 4,189,934, which are incorporated herein by this reference.

The upright post 22 of the pulling apparatus preferably comprises a pair of spaced apart, substantially parallel and vertically extending load-resisting members, each of which are rigidly supported upon a base 28 which rests on the floor 18. The base is not rigidly affixed to the floor because the post must be portable for allowing it to be easily moved about the repair shop to facilitate making pulls in many directions and at different points on the vehicle. The post may be supported on the base by a pair of depending diverging elongated support members 30 and 32 shown on one side of the post in FIGS. 1 and 2. A pair of upright support members 33 (only one is shown in FIGS. 1 and 2) are rigidly affixed to the base 28 and to the bottom of the support members 30 for adding additional rigidity. A pulling chain guide member preferably in the form of a pulley 34 is rotatably supported on a shaft 36 extending between the vertical members of the post 22. The post members can include a series of vertically spaced apart holes 40 in which the shaft of the pulley 34 can be removably mounted for adjusting the elevation of the pull provided by the pulling chain 16.

In order to exert a pulling force on the pulling chain 16, a hydraulic power cylinder 42 is mounted near the base of the post. The cylinder is preferably pivotally connected between the support members of the post assembly by a pin 44. The opposite end of the power cylinder is pivotally connected adjacent the upper end of a pivot arm 46. A suitable power source, not shown, may be connected to the power cylinder to control operation of the hydraulic piston or ram 48 as it reciprocates for either applying a force or being retracted to release a pulling force.

The pulling chain 16 passes over the guide pulley 34 and then preferably passes downwardly along the post and around a secondary guide pulley 50 mounted on a pivot pin 52 between the upright support members of the post 22. The pulling chain passes around the secondary guide pulley 50 and then is affixed to the upper end of the pivot arm 46. Thus, when the hydraulic cylinder 42 is pressurized, its power-applying piston arm 48 extends outwardly to rotate the pivot arm 46 (in a counterclockwise direction with respect to FIG. 2) for applying a force to the pulling chain 16. This pulls the pulling chain in a direction away from the vehicle 14 shown in FIG. 1 to apply a pulling force to the vehicle in the conventional manner.

The primary anchor chain 24 is preferably coupled to the post 22 at an elevation in close proximity to the point on the post at which the guide pulley 34 is mounted. By coupling the anchor chain in close proximity to the pulley 34, the restraint provided by the anchor chain in combination with the force applied by the pulling chain during use does not apply substantial bending moments to the post. Preferably, the anchor chain is connected to the post by a bracket 52 which may be engaged with the pivot pin 36 that also supports the pulley 34. In this way, the pulley 34 and anchor chain bracket 52 can be moved up and down along the post in unison when the elevation of the pull is adjusted.

The secondary anchor chain 26 is coupled to the post preferably at a location below the guide pulley 34. Preferably the upper end or ends of the secondary anchor chain 26 are affixed to the post 22 by fastening the secondary anchor chain to a pair of U-shaped attachment members 54 secured to oppositely outwardly facing surfaces of the vertical members which comprise the post. Only one of the attachment members 54 is shown in FIGS. 1 and 2. They are identical, and therefore, only one will be described in detail. In a preferred embodiment, each attachment member is a generally U-shaped member having substantially parallel coplanar spaced apart legs which are preferably secured to the outer surface of each vertical member of the post by welding. The legs are preferably vertically spaced apart on the post surface, although they could also be horizontally spaced apart. The U-shaped members also can be replaced with other suitable attachment means such as a circular ring or other shackle or bracket or the like as long as the attachment member 54 provides a means for rigidly affixing the anchor chain 26, either directly or indirectly, to opposite sides of the post. The preferred method for connecting the secondary anchor chain 26 to the attachment members 54 and then to the anchor pot 20 is described in more detail below.

Figure 3:
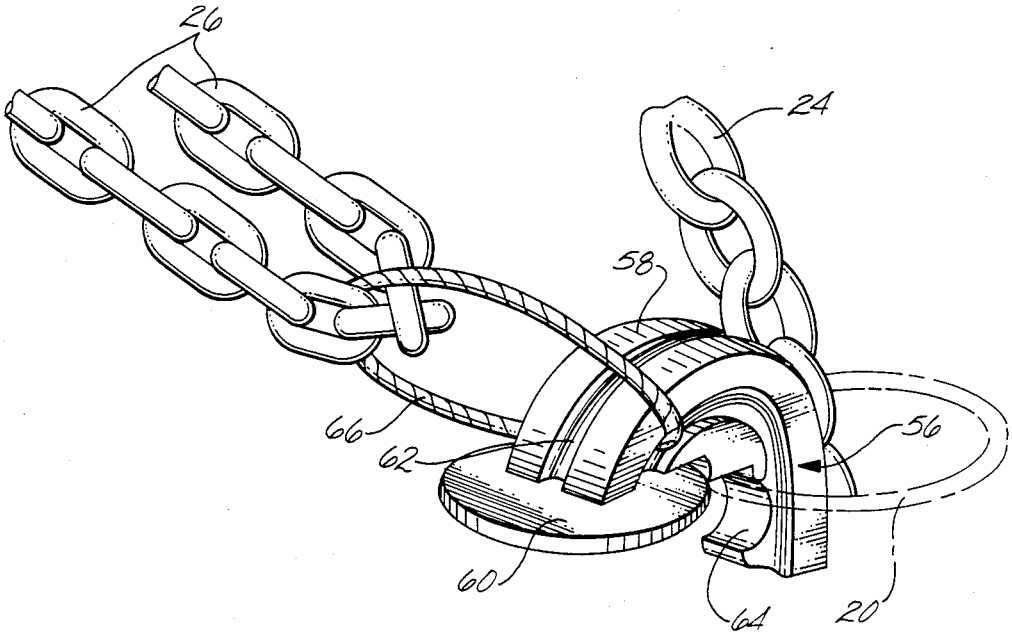
FIG. 3 is a fragmentary perspective view illustrating a safety tie down apparatus in use.
Figure 4:
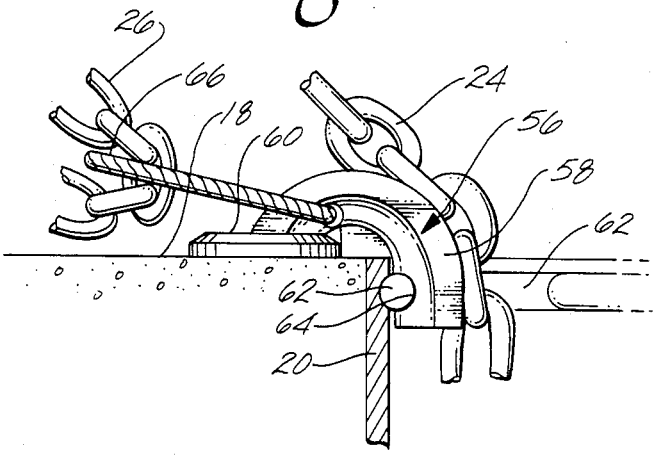
FIG. 4 is a fragmentary side elevation view, partly in cross section, of the arrangement shown in FIG. 3.

FIGS. 3 and 4 best illustrate the safety tie down apparatus of this invention. A curved reinforcement member 56, also referred to herein as a combined chain rest and safety line anchor, is removably placed in an edge of the cylindrical ring portion of the anchor pot 20. The reinforcing member 56 has a curved guide 58 which is a one-piece rigid metal casting. A portion of the casting extends downwardly along the side of the anchor pot cylindrical interior wall. The guide 58 curves over the edge of the anchor pot and then curves down toward the floor 18 where it terminates in a large circular pressure-applying foot 60 that bears agaisnt the floor when force is applied to the guide member. The foot 60 spreads the force applied to the guide member across the floor to equalize the pressure and prevent it from being otherwise concentrated at the floor in a manner which could damage the concrete floor. The guide member 58 has a pair of side flanges on opposite sides of a groove 62 through which the primary anchor chain 24 passes. This holds the primary anchor chain 24 in place on the reinforcing member so that any forces applied to the floor from tension applied to the anchor chain 24 are applied to the reinforcing member 56.

The reinforcing member is preferably placed in the edge of the anchor pot 20 by engaging a lower portion of the curved member 56 with a support ring 62 affixed to the inside face of the cylindrical wall of the anchor pot 20. As shown best in FIG. 4, the support ring 62 is partially embedded in the wall of the anchor pot and is welded or otherwise rigidly affixed to the cylindrical wall of the anchor pot so as to extend around the entire interior of the anchor pot a short distance below the upper edge of the anchor pot cylinder. Thus, the ring 62 extends parallel to the upper edge of the anchor pot cylinder continuously around the interior of the anchor pot. The curved guide portion 58 of the reinforcing member 56 has a semicircular outwardly facing recess 64 for engaging the outer surface of the ring 62. When the reinforcing member is placed in the anchor pot, the lower portion of the curved guide member 58 is simply slipped into the interior of the anchor pot cylinder, and the recess 64 is engaged with the ring 62. The ring and recess are simply slipped into engagement with each other and not otherwise rigidly fastened together. The attachment of the reinforcing member to the anchor pot is thus removable in the sense that the two members interlock in a passive engagement without being rigidly affixed to one another such as by fasteners. Once a pulling force is applied to the pulling chain 16, the opposed tension in the primary anchor chain 24 applies a force to the curved guide member 58 which applies sufficient pressure against the ring 62 in a direction to hold the reinforcing member 56 in a stationary position in the anchor pot as the pulling force is being applied. Consequently, the reinforcing member 56 provides a convenient means for hooking the end of the primary anchor chain 24 to the anchor pot, since the reinforcing member can simply be placed in the anchor pot on the opposite side of any pull and releasably interlocked with the anchor pot, after which the anchor chain is placed in the chain guide and the proper length of the anchor chain is then adjusted at its connection to the bracket 52 on the post.

An anchor ring 66 is connected to a front portion of the curved guide portion of the reinforcing member 56. The anchor ring is preferably a length of ⅜-inch thick wire rope, about seven inches in diameter, capable of withstanding pulling forces well in excess of ten tons. The anchor ring passes through a hole 68 on the curved guide portion of the reinforcing member a short distance above the pressure-applying foot 60, below the curved chain rest guide for the primary anchor chain. The secondary safety chain 26 is then connected between the attachment members 54 of the post and the anchor ring 66. Preferably, the secondary anchor chain 26 is connected between the anchor pot and the attachment member 54 as a single length of chain. One end of the chain 26 is connected to one of the attachment members 54 on the post; the chain 26 then extends toward the anchor pot and through the reinforcing ring 66; and the chain 26 is then extended back toward the post where its opposite end is connected to the other attachment member 54 on the opposite face of the post 22. Both ends of the secondary safety chain 26 are coupled to removable hooks or the like so that the length of the single chain 26 can be easily adjusted depending upon the distance between the post and the anchor pot. Alternatively, a single secondary anchor chain 26 can be used by connecting its lower end to the anchor ring 66 by looping the end of the chain through the ring 66 and hooking it to the ring with a hook; while the upper end of the single anchor chain 26 is connected to a yoke which, in turn, is connected to the attachment members 54 on opposite sides of the post.

Figure 5:
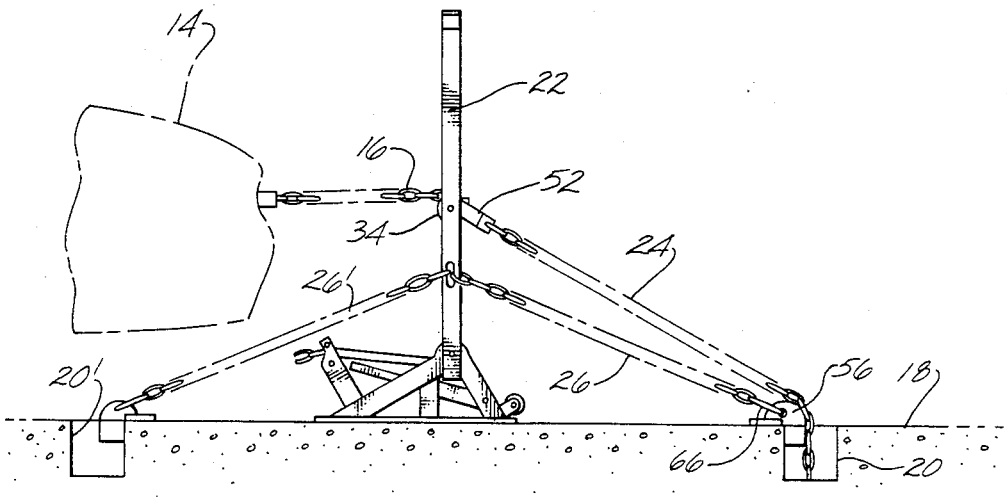
FIG. 5 is a schematic side view of an alternative floor pull system.

FIG. 5 illustrates a further safety tie arrangement wherein a pair of auxiliary safety chains 26' are connected at their upper ends to the post and then extend toward the vehicle for attachment to anchor pots 20' on opposite sides of the vehicle. Only one of the auxiliary safety chains 26' is shown in FIG. 5. In this arrangement, the secondary anchor chain 26 is connected to the anchor pot 20 and anchor ring 66 in the manner identical to that described with reference to FIGS. 3 and 4. As mentioned above, the secondary anchor chain 26 provides a means for restraining the post 22 in the event of chain failure causing the post to otherwise move toward the vehicle. The auxiliary safety chains 26' which extend toward the vehicle can provide a further safety restraint for pulling chain failures that may otherwise cause the post to move away from the vehicle.

In using the pulling apparatus and safety tie down assembly of the present invention, the pulling apparatus is first positioned relative to the vehicle and the floor anchor 20. Thereafter, the pulling chain 16 is connected to the vehicle and the primary and secondary anchor chains 24 and 26 are connected to the anchor pot and to the anchor ring 66, respectively. The pulley 34 is adjusted to a suitable height to provide the proper pulling angle. The power cylinder 42 is then pressurized to extend the piston arm 48 which, in turn, exerts a pulling force on the vehicle through the pulling chain 16. The primary anchor chain is set at a length that provides the required restraining force for the pull applied by the pulling chain. The primary anchor chain thus is tensioned immediately when a pulling force is applied so that the post remains upright as the pulling force is applied. The secondary anchor chain 26 is connected at a length in which it does not become tensioned when the primary anchor chain is tensioned. In the event the primary anchor chain 24 should break or become detached from the anchor pot or from the post, the secondary anchor chain 26 restrains the pulling apparatus to prevent it from jumping forward toward the vehicle. The anchor ring 66 is of sufficient strength to resist the pulling force when it suddenly transfers to the secondary anchor chain. This sudden transfer of the restraining force is applied to the reinforcing member 56 also in a manner which keeps the reinforcing member in place in the floor anchor pot.

In addition, the arrangement shown in FIG. 5 can be used so that the auxiliary safety tie down chains 26' can be prevent the post from jumping away from the vehicle if there is a failure of the pulling chain 16 or its connection to the vehicle 14.

The safety tie down apparatus of this invention is extremely valuable in its ability to provide a single anchor point on the floor for both the primary anchor chain and a secondary anchor chain. Inasmuch as both anchor chains are fixed to a single removable anchor member which easily slips into engagement with the floor anchor, the repairman can quickly and easily hook up both the primary and secondary anchoring chains in a single operation. This has the unique advantage of reducing the time required to safely hook up the post for a pull when compared with an arrangement requiring multiple safety tie down chains attached to a second and third floor anchor; it also has the advantage of encouraging the repairman to connect the secondary anchor chain in the first place inasmuch as it eliminates the more cumbersome and time-consuming attachment to second and third anchor pots which often discourages the repairman from otherwise using the safety tie downs. The safety tie down apparatus of this invention also makes it possible to set up the post at any location within the array of floor anchors. Since the primary and secondary anchor chains are connected solely to a single anchor pot, the pull can be applied from any of the corner regions of the array of floor anchors where additional floor anchors are often unavailable in the prior art system which requires safety tie connections to second and third floor anchors. The single floor anchor connection also provides a useful means of equalizing the restraining force on the post which may not always be easily equalized by primary and secondary safety tie downs of different lengths.

I claim:

1. In a pulling apparatus which includes a post assembly, guide means on the post assembly, power means on the post assembly, flexible pulling means having one end connected to the power means and extending into engagement with the guide means with the other end adapted for connection to a work piece, and primary flexible anchor means having one end secured to the post assembly with an opposite end adapted for connection to an anchor pot on the floor, a safety tie down assembly comprising:

secondary flexible anchor means having a first end adapted for connection to the post assembly;

a safety line anchor for passive removable engagement with the anchor pot and having means for engagement with the primary anchor line when the primary anchor line is held in tension between the post assembly and the anchor pot as a pulling force is applied by the pulling chain; and attachment means on the safety line anchor for connection to a second end of the secondary anchor means; so the secondary anchor means restrains movement of the pulling apparatus along the line in which the pulling force is directed should the restraint provided by the primary anchor means fail.

2. Apparatus according to claim 1 which further includes a pair of additional secondary anchor lines extending from opposite sides of the post toward the work piece for connection to separate anchor pots embedded in the floor and spaced laterally from the post on a side of the post opposite from the anchor pot to which the primary and secondary anchor means are attached.

3. Apparatus according to claim 1 in which the attachment means on the safety line anchor comprises a cable in the form of an anchor ring affixed to the safety line anchor.

4. Apparatus according to claim 3 in which the secondary anchor means comprises a flexible single anchor chain extending from a first point of attachment on the post assembly, through the anchor ring, and then back to a second point of attachment on the post assembly on the side opposite from the first point of attachment.

5. Apparatus according to claim 3 in which the ring-like cable is affixed to a portion of the safety line anchor above the force-distributing member and below where the primary anchor means engages the safety line anchor.

6. Apparatus according to claim 3 in which the safety line anchor comprises a rigid support for being removably placed in the anchor pot to provide means for interlocking engagement with the primary pot to act as a force-distributing member between the floor and the primary anchor means.

7. Apparatus according to claim 6 in which the rigid support portion of the safety line anchor is releasably engaged with a projecting shoulder on the anchor pot.

8. For use in a pulling apparatus which includes a post assembly, guide means on the post assembly, power means on the post assembly, flexible pulling means having one end connected to the power means and extending into engagement with guide means with the other end adapted for connection to a work piece, and primary flexible anchor line having one end secured to the post assembly with an opposite end adapted for connection to an anchor pot embedded in the floor, a safety tie down anchor assembly comprising:

a rigid anchor support for passive removable placement in the anchor pot so that the primary anchor line attached to the post assembly can pass into contact with the anchor support prior to attachment of the primary anchor line to the anchor pot, so that the primary anchor line can restrain a pulling force applied to a vehicle by the pulling chain, and so that the anchor support can be interposed between the primary anchor line and the floor in which the anchor pot is anchored to uniformly distribute the restraining force against the floor; and an anchor ring affixed to the anchor support and having sufficient strength to resist at least the same amount of force that is resisted by the primary anchor chain when the post assembly is used to apply a pulling force to the vehicle, the anchor ring providing a means for attachment for a secondary anchor line extending from the anchor ring to the post assembly to restrain movement of the pulling apparatus along the line in which the pulling force is directed.

9. Apparatus according to claim 8 in which the anchor ring is attached to the anchor support on a side of the anchor support between the post assembly and the point of engagement of the primary anchor line with the anchor support.

10. Apparatus according to claim 9 in which the anchor support further includes a force-distributing portion for resting on the floor adjacent the edge of the anchor pot to uniformly distribute pressure applied to the anchor support in response to tensioning of the primary anchor line.

11. Apparatus according to claim 10 in which the anchor ring is attached to the anchor support in close proximity to the force-distributing member, below the point of engagement with the primary anchor line.

12. Apparatus according to claim 11 in which the anchor support has a lower portion for extending into the upper interior portion of the anchor pot with a recessed outer face for engagement with a corresponding shoulder inside the anchor pot to provide a passive interlocked means of engagement.

13. A pulling apparatus comprising:

a post assembly;

guide means on the post assembly;

power means on the post assembly;

flexible pulling means having one end connected to the power means and extending into engagement with the guide means with an opposite end adapted for connection to a work piece;

primary anchor means including at least one flexible anchor means having one end secured to the post assembly with the opposite end connected to an anchor pot on the floor;

a safety tie down line having a first end connected to the post assembly;

a safety line anchor passively removably placed in an edge of the anchor pot for being interposed between the primary anchor line and the anchor pot to act as a reinforcing member between the floor and the primary anchor line when tension is applied to the primary anchor line as a pulling force is applied to the vehicle through the pulling means;

an anchor ring affixed to the safety line anchor; and a secondary anchor line connected between the anchor ring and the post assembly so as to restrain movement of the pulling apparatus along the line in which the pulling force is directed.

14. Apparatus according to claim 13 in which the anchor support further includes a force-distributing portion for resting on the floor adjacent the edge of the anchor pot to uniformly distribute pressure applied to the anchor support in response to tensioning of the primary anchor line.

15. Apparatus according to claim 14 in which the anchor ring is attached to the anchor support in close proximity to the force-distributing member, below the point of engagement with the primary anchor line.

16. Apparatus according to claim 15 in which the anchor support has a lower portion for extending into the upper interior portion of the anchor pot with a recessed outer face for engagement with a corresponding shoulder inside the anchor pot to provide a passive interlocked means of engagement.

17. Apparatus according to claim 16 including a pair of auxiliary safety tie down lines extending from the post assembly toward the work piece and attached to additional separate floor anchors on opposite sides of the post.

* * * * *